US006824225B2

(12) United States Patent
Stiffler

(10) Patent No.: US 6,824,225 B2
(45) Date of Patent: Nov. 30, 2004

(54) EMBOSSED WASHER

(75) Inventor: Stephen P. Stiffler, New Enterprise, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/120,696

(22) Filed: Apr. 11, 2002

(65) Prior Publication Data

US 2003/0047985 A1 Mar. 13, 2003

Related U.S. Application Data

(60) Provisional application No. 60/318,348, filed on Sep. 10, 2001.

(51) Int. Cl.[7] ..... E21C 25/08

(52) U.S. Cl. ..... 299/104; 299/105

(58) Field of Search ..... 299/102, 104, 299/105, 106, 103; 411/161, 160, 162, 163

(56) References Cited

U.S. PATENT DOCUMENTS

| | | | | | |
|---|---|---|---|---|---|
| 891,574 | A | * | 6/1908 | Swain | 411/144 |
| 2,034,494 | A | * | 3/1936 | Stoll | 411/147 |
| 2,778,399 | A | * | 1/1957 | Mroz | 411/161 |
| 3,746,396 | A | * | 7/1973 | Radd | 299/10 |
| 4,489,986 | A | * | 12/1984 | Dziak | 299/104 |
| 4,561,698 | A | | 12/1985 | Beebe | 299/86 |
| 4,818,027 | A | | 4/1989 | Simon | 299/92 |
| 4,932,723 | A | * | 6/1990 | Mills | 299/104 |
| 5,007,685 | A | | 4/1991 | Beach et al. | 299/91 |
| 5,374,111 | A | | 12/1994 | DenBesten | 299/86 |
| 5,829,933 | A | * | 11/1998 | Kramer | 411/156 |
| 5,931,542 | A | | 8/1999 | Britzke et al. | 299/104 |
| 6,113,195 | A | | 9/2000 | Mercier et al. | 299/104 |
| 6,152,665 | A | * | 11/2000 | Wallace et al. | 411/11 |
| 6,164,728 | A | | 12/2000 | Sollami | 299/104 |
| 6,357,832 | B1 | * | 3/2002 | Sollami | 299/104 |

FOREIGN PATENT DOCUMENTS

| | | |
|---|---|---|
| EP | 0413917 | 2/1991 |
| RU | 2123594 | 12/1998 |
| WO | WO0043596 | 7/2000 |

OTHER PUBLICATIONS

PCT International Search Report in PCT/US02/27700, international filing date Aug. 30, 2002, mailed Aug. 30, 2002.

Ober, Erik et al., Machinery's Handbook, 23rd Edition, New York, (p. 2102), no date.

Kennametal Inc. catalogue, "Road Planing, Soil Stabilization, and Reclamation Tools," 2001, B01–1(12)D1 (43 pages).

* cited by examiner

*Primary Examiner*—David Bagnell
*Assistant Examiner*—Daniel P Stephenson
(74) *Attorney, Agent, or Firm*—John J. Prizzi

(57) ABSTRACT

A rotatable cutting bit, and rotatable cutting bit—bit holder assembly and washer that have increased wear resistance characteristics. The assembly incorporates a new holding washer design that has improved rotational characteristics between the cutter bit and top surface of the washer during operation. The washer includes a front face and a generally flat rear face, said front face has a plurality of ridges, said ridges each have a top face forming a bearing surface for the cutting bit to enhance rotation of the cutter bit and the flat rear face reduces rotation of said washer. The relative rotation between the rear face of the washer and front of the block face is reduced in the present invention. The improved wear resistance properties of the invention reduce the amount of necessary maintenance of rotary drums in the field resulting in reduce downtime and increase productivity. The washer is also simple to manufacture in a cost effective manner and easy to assemble in the field.

35 Claims, 3 Drawing Sheets

FIG. 1
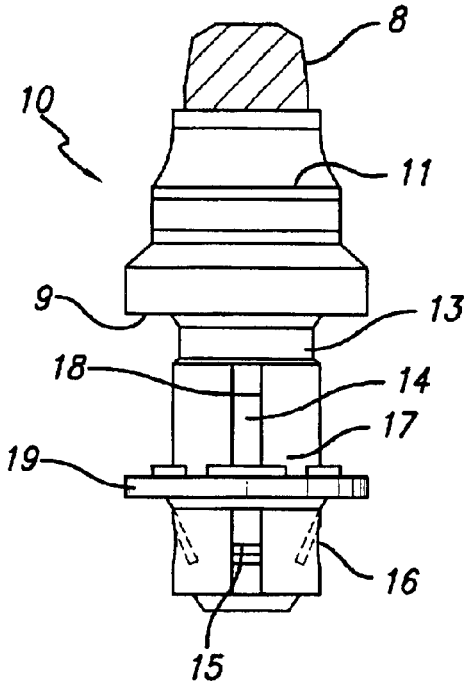
FIG. 2
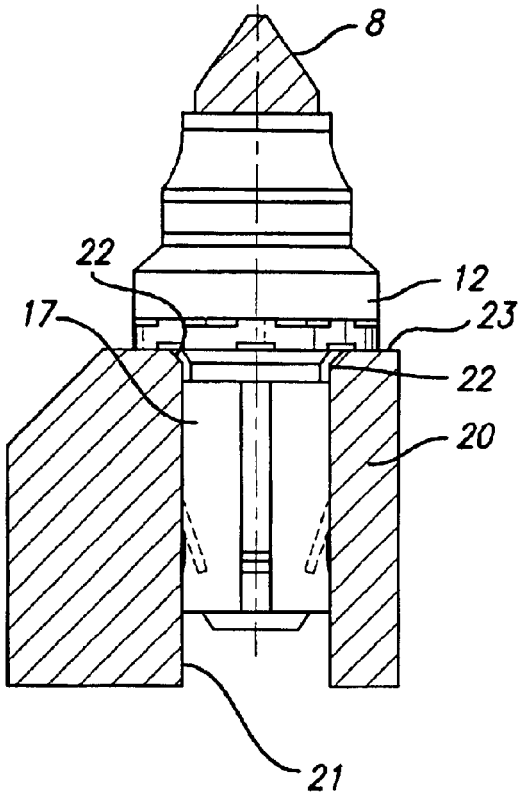
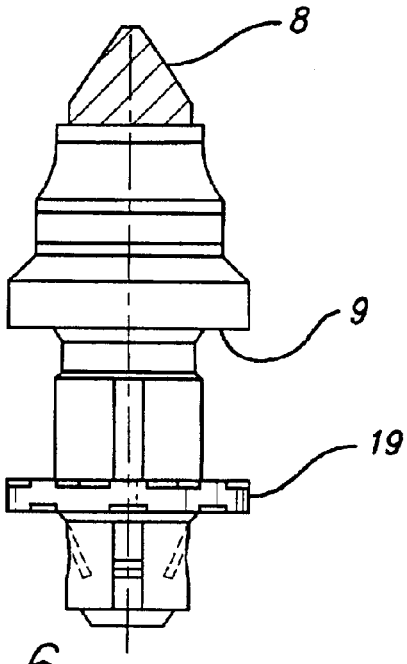
FIG. 6

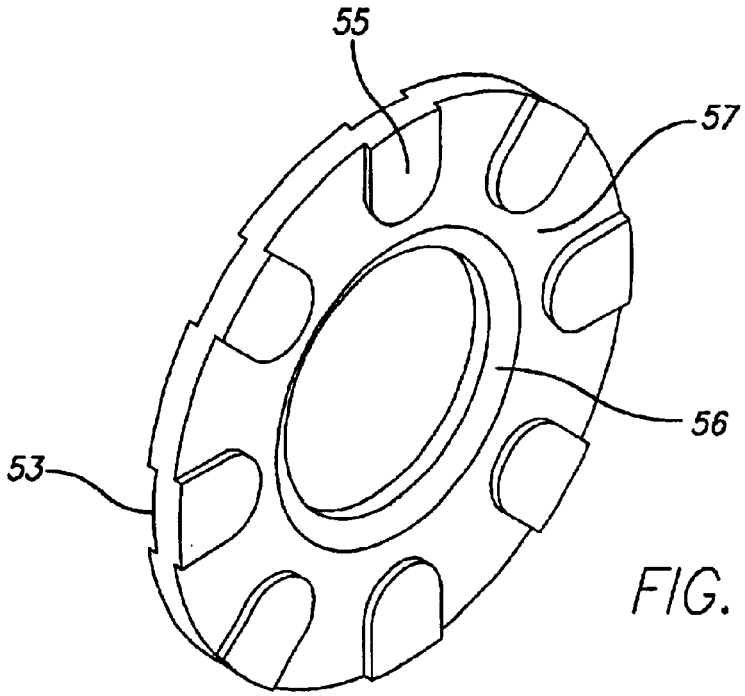
FIG. 7
FIG. 8
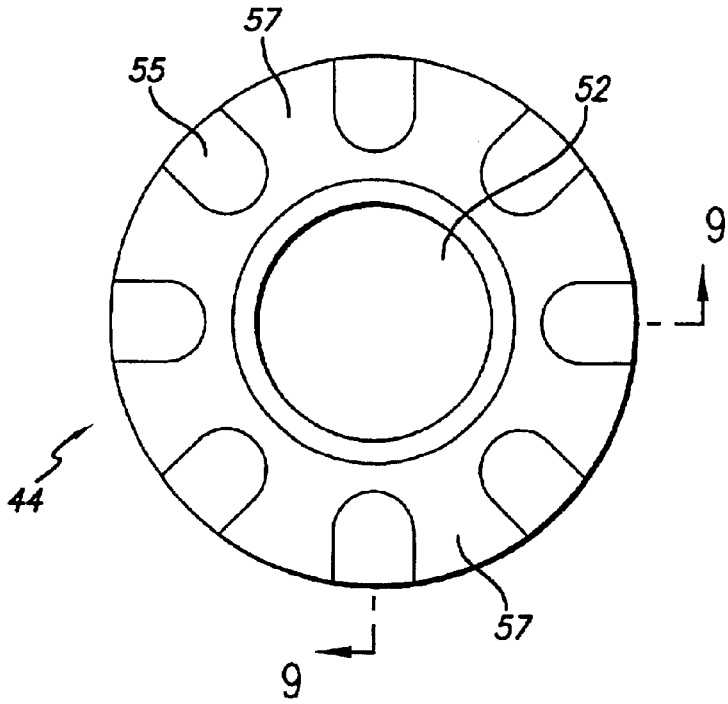
FIG. 9
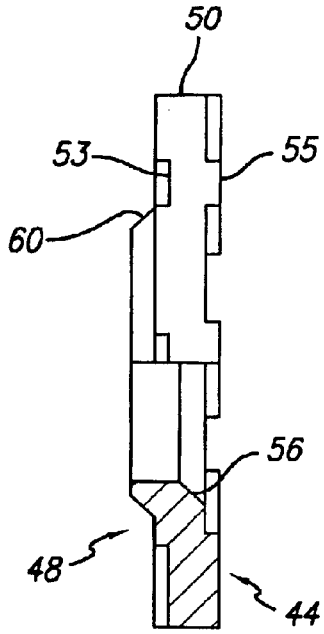

EMBOSSED WASHER

BACKGROUND OF THE INVENTION

This application is a nonprovisional application of U.S. Provisional Application No. 60/318,348, filed Sep. 10, 2001.

The present invention relates to mining and construction cutting bits and holders, the holders being attached to a rotating cutting drum. In the past, rotatable cutting tools have been put to a number of uses, including use as a mine tool in a continuous mining machine. Typically, a continuous mining machine includes a driven rotatable drum having a plurality of support blocks affixed thereto.

The invention concerns a rotatable cutting bit, as well as the bit holder, wherein the cutting bit has a hard insert at the forward end thereof. The cutting bit rotatably mounts in the bit holder. More specifically, the invention pertains to such a rotatable cutting bit, as well as the bit holder, designed so as to exhibit a reduction in the impediment to rotation, and thereby provide for improved rotation, between the bit and the bit holder. The invention also provides for a rotatable cutting bit, as well as the bit holder, which provides for improved wear protection for the bit holder during operation.

In the prior art, such as U.S. Pat. No. 6,113,195, to Mercier et al., and U.S. Pat. No. 4,818,027, to Simon, the bit block holder is protected from wear caused by rotation of the cutter bit head and shank by a holding washer element and spring sleeve retainer respectively. In the cutter bit provided with the holding washer element, the clamping sleeve is held tightly enough that the cutter bit with the clamping sleeve can be pushed into the bore of the bit holder even manually over a great portion of its axial dimension, until, for example, the holding element abuts on the insertion side of the bit holder. The cutter bit can be driven to the shoulder of the bit head adjacent the bit holder by means of a hammer blow. By this means, the holding element is slid from the clamping sleeve, and reaches an area of the bit shank free from the clamping sleeve, so that the clamping sleeve, with the clamping force particular to it, can be tensed in the bore of the bit holder, whereby the tension force correspondingly increases with increasing drive-in depth.

In operation, the drum rotated whereby the rotatable cutting tools impacted the earth formation, such as, for example, coal, so as to cut and break up the earth formation. As can be appreciated, the earlier rotatable cutting bits operated in an environment in which small particles of the earth formation impacted by the bit, such as coal, impinged upon the cutting bit. As the length of operation increased, these contaminants or debris had the tendency to become sandwiched between the rotatable cutting bit and the bit holder. If the amount of contaminants or debris became too great, it impeded the rotation of the cutting bit. Despite prior art designs to allow free rotation, certain cutting applications such as asphalt milling and the continuous mining of coal cause tool rotation to be inhibited by fines accumulating between the mating surfaces of the tool holder and cutter tool. Once the accumulated fines become tightly packed between the tool retainer and the tool body and/or between the tool shoulder and the holder face, rotation is greatly reduced. Following reduced rotation, a wear flat will develop on the hard tip of the tool progressing down onto the steel body. After developing a wear flat, the tool rotation generally stops, whereby the remaining useful tool life is lost.

During the operation of the earlier cutting bits, the support block experienced wear due to the contact and rotation between the cutting bit and the support block, as well as the impingement of the debris from the cutting operation. In other prior art, such as U.S. Pat. Nos. 6,113,195 and 4,818,027, which incorporate a washer between the cutting bit and support block, the wear to the bit support block is reduced, however, during operation of said prior art and the holding element washer does not remain in a fixed position on the top face of the bit block. The holding washer elements in said prior art have a tendency to rotate on the top face of the bit block due to the contact between the washer and rotating cutter bit.

While the cutting bit was replaced on a periodic basis after the expiration of the useful life thereof, the support block was typically intended to be functional much longer than the cutting bit. As the bore and front face of the support block became worn, the support block lost its effectiveness due to deformation and wear of the bore and the front face thereof. In the case of the bore, it lost its initial cylindrical shape by becoming out-of-round, oversized or bell-mouthed. In the case of the front face of the support block, it lost its flatness. Each one of these conditions impeded the satisfactory rotation of the cutting bit in the support block.

In U.S. Pat. No. 5,931,542 to Britzke et al., the cutter bit assembly was designed to prevent rotation of the washer. The cutter bit assembly in Britzke et al. includes a substantially circular wear washer having a radially inwardly directed key. The wear washer key is adapted to fit within the retainer sleeve slot, thereby interlocking the retainer sleeve with the wear washer. This provided the benefit of greatly reducing wear on the top face of the bit block. This prior art design required additional cold work machining of the block and of the washer to form the key. In the field, upon insertion into the bit block, the washer key often became broken off in use or knocked out of its cooperating keyway groove so that the washer would not be fixed in position.

It is, therefore, apparent that in light of the past experience of earlier cutting bits, it would be beneficial to provide a rotatable cutting bit which has an improved ability to freely rotate during operation.

It would, therefore, be very advantageous to provide a cutting bit, which, during operation, protects the bore of the bit holder, as well as the front face of the support block, from deformation. By providing this protection, a cutting bit would help prolong the useful life of the support block, as well as help the rotation of the cutting bit.

SUMMARY OF THE INVENTION

It is an object of the invention to provide a rotatable cutting bit, and rotatable cutting bit-bit holder assembly and washer that have improved wear resistance characteristics.

It is an object of the invention to provide a rotatable cutting bit, and rotatable cutting bit-bit holder assembly, that has improved rotational characteristics between the cutter bit and top surface of the washer during operation.

An object of the present invention is to provide an efficient means for protecting holding support blocks, of the type used to hold cutting bits used in pulverizer and rotary drum or wheel machines, from excessive abrasion and impact damage. It is believed that the relative rotation between the rear face of the washer and front of the block face is reduced in the present invention.

The improved wear resistance properties of the invention reduce the amount of necessary maintenance of rotary drums in the field, resulting in reduced downtime and increased productivity. The invention is also simple to manufacture in a cost effective manner and easy to assemble in the field.

BRIEF DESCRIPTION OF THE DRAWINGS

FIG. 1 illustrates a side view of a first embodiment of a cutting bit having a holding washer having ridges and recesses, the holding washer maintains the clamping sleeve in a loaded state with a smaller diameter than the bore in the bit holder block.

FIG. 2 illustrates a side view of a second cutting bit assembly embodiment having a holding washer having ridges and recesses inserted into its operating position in a bit holder block wherein the holding washer abuts against the top face of the block and has released the clamping sleeve which is now loaded against the bore of the bit block.

FIG. 6 illustrates a side view of the second embodiment illustrated in FIG. 2, wherein the holding washer is maintaining the clamping sleeve in a loaded state prior to insertion into the block with a smaller diameter than the bore in the bit holder block.

FIG. 7 is a perspective view of the holding washer of the second embodiment illustrated in FIGS. 2 and 6.

FIG. 8 illustrates a top view of the holding washer in the second embodiment.

FIG. 9 is a cross sectional view along lines 9—9 of FIG. 8.

DETAILED DESCRIPTION OF THE INVENTION

Figure 3:
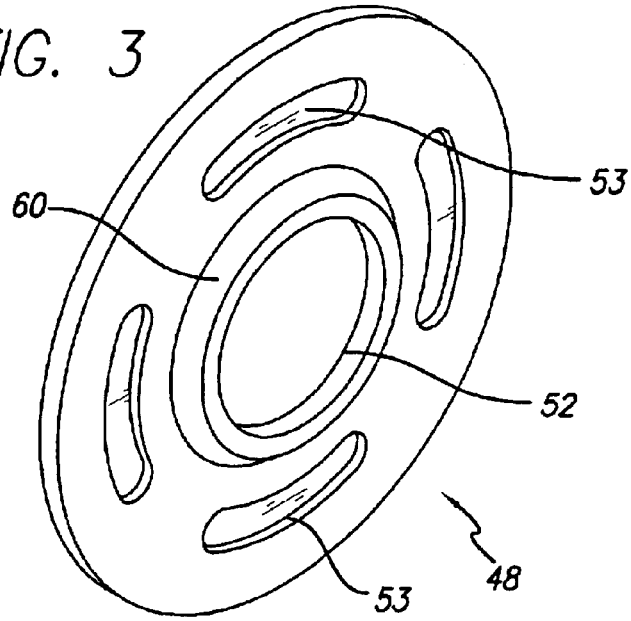
FIG. 3 is a bottom perspective view of the holding washer of the first embodiment shown in FIG. 1.
Figure 4:
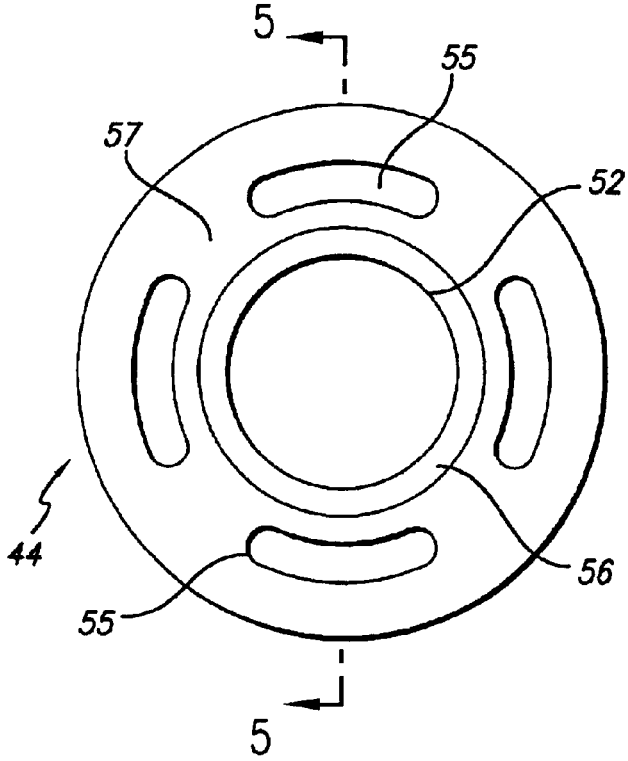
FIG. 4 illustrates a top view of the first embodiment of a holding washer illustrated in FIG. 3.

In the embodiment shown in FIG. 1, bit shank 14 projects from bit head 11. The transition between the bit head 11 and bit shank 14 is constructed as collar 12, which forms the greatest external diameter of bit head 11. The hard metal insert 8 is inserted into the bit tip in the known manner. The clamping sleeve 17 provided with the longitudinal slot 18 rests in circumferential groove on the bit shank 14. Clamping sleeve 17 extends over the greatest portion of the axial dimension of bit shank 14. Stop tabs 16 (in phantom lines) project radially inward for cooperation with a recessed annular groove 15. The bottom end of the tabs abut against an annular surface of the groove that extends perpendicular to the longitudinal axis of the shank as well-known in the art. A holding washer element 19 is slid onto clamping sleeve 17. The washer compresses the clamping sleeve 17 to such an extent that its external diameter is equal to or smaller than the diameter of bore 21 in bit holder 20. Longitudinal slot 18 is wide enough so that clamping sleeve 17 can be pressed together far enough that its internal wall lies on bit shank 14. Since bore 21 of bit holder 20 is provided with diverging frustoconical opening 22, the bit shank 14 of cutter bit 10 can be easily inserted into bore 21. This insertion process can be carried out manually, until holding element 19 strikes the frontal side of the bit holder 20. Then with increased application of force, for example, by means of a blow from a hammer, the cutter bit 10 can be driven far enough into bore 21 so that collar 12 of bit head 11, by means of the holding element 19, is driven to face against the frontal side of bit holder 20 as illustrated in FIG. 2 (second embodiment). In this manner, holding element 19 formed as a holding washer is moved from clamping sleeve 17 down onto the free area 13 of the bit shank 14 between clamping sleeve 17 and the bit head 11, so that it releases clamping sleeve 17. Clamping sleeve 17 can now be tensed with the tensing force specific to it, in the bore 21 of bit holder 20, since it would accommodate, in the unstressed condition, an external diameter which is greater than the diameter of bore 21 of bit holder 20. The difference between both diameter values determines the tensing force of sleeve 17, and thereby the force with which the cutter bit 10 is held in bore 21 of bit holder 20.

In the embodiment in accordance with FIG. 1, the external diameter of the holding washer corresponds to the maximum external diameter of bit head 11 in the area of collar 12. The holding washer thereby serves as a protective washer for bit holder 20, since it cushions the impact forces acting on cutter bit 10 and prevents abrasion and wear of the bit block caused by the cutter bit bearing down upon the bit block as it rotates during operation. If the external diameter of the holding washer is expanded over the maximum external diameter of the bit head 11, then the entire frontal side of the bit holder 20 is protected against wear, if the holding washer is made of wear-resistant material.

Figure 5:
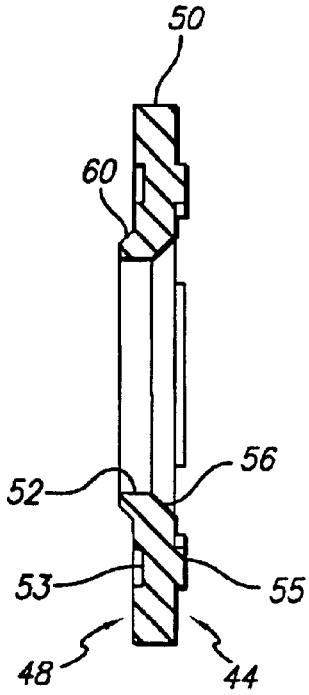
FIG. 5 is a cross sectional view along lines 5—5 of FIG. 4.

FIG. 5 illustrate a cross-sectional view of the holding washer in which each of the front and rear main surfaces 44, 48 extends from the outer peripheral surface 50 to the inner peripheral surface of the central opening 52 which defines the center hole of the washer. The front main surface 44 is a generally flat shape and has a plurality of evenly spaced arcuate ridge segments 55. Front face 44 also includes a bevel 56 (e.g., a bevel of 40–50 degrees.) at the intersection with the inner peripheral surface 52 that defines the central opening in the washer. Rear surface 48 is also generally flat and has a plurality of evenly spaced recesses 53 as best seen in FIG. 3. For the purpose of this invention it is not necessary that the rear surface is beveled at 60 or that the front face is beveled 56.

Similar to FIG. 2, the holding washer of the first embodiment of FIG. 1 in its operating position is located between the cutting bit shoulder 12 and top face 23 of the bit block. The bottom face 9 of the cutter bit rests upon the top face of the ridges 55. The top faces of the ridges form a bearing surface about which the cutter bit rotates. In the prior art the bottom horizontal surface 9 of the cutter bit abuts against a horizontal front surface of the washer as illustrated in FIG. 1 of U.S. Pat. No. 4,818,027. This '027 flat washer and a corresponding flat surface of the cutter bit shoulder cooperate to form a large contact area at a significant distance from the cutter bits axis of rotation. With the washer of the invention, only the top surfaces of the ridges 55 contact the bottom flat surface 9 of the cutter bit shoulder. This bearing surface contact between the holding washer and cutter bit bottom reduces torsion friction that inhibits relative rotation between the cutter bit and washer in comparison to a flat washer of the same size.

In prior art designs of rotating cutter bits, in some cutting applications such as asphalt milling and the continuous mining of coal, cause tool rotation to be inhibited by fines accumulating between the mating surfaces of the tool holder and cutter tool. It is believed the flat section gaps 57 between ridges 55 permit for uninhibited flow of fines and cut particles so as to help reduce accumulation of the fines in some milling and coal operation environments in which accumulation of fines and debris sandwiched between the top mating surface of holder washers and bottom mating surface of the cutting bit is more prevalent. The length of the gap may be varied as well as the height of the gap (i.e. ridge height) to appropriately accommodate the prevailing particle size that causes accumulation problems in certain mining and construction environments. In other mining and construction environments in which sandwiched accumulation of fines and debris between mating surfaces is not a problem, the gaps may not be necessary and a continuous concentric annular ridge may be constructed with smaller gaps or possibly without any gaps (not shown).

In some prior art designs, such as U.S. Pat. No. 6,113,195, which has a beveled washer, the cutter bit shoulder does not rest flatly on the holding washer element. However, in U.S. Pat. No. 6,113,195, the washer is beveled so that the rear surface of the washer does not rest flatly upon the top face of the block either, but makes minimal contact or line contact with the top face of the bit block about the circumference of the bore close to the cutter's central axis. The rear surface 48 of the invention sits flatly on a flat horizontal top face of the bit block. Hence, the radial outward surface contact between the washer and top face of the bit block is greater than such prior art designs as U.S. Pat. No. 6,113,195. This surface contact area between the washer and top face of the bit block is made at a greater distance from the central axis increasing torsion friction and resistance to relative rotation between the holding washer 19 and bit block face 23. This reduction in rotation of the washer upon the bit block reduces undesirable wear such as countersinking.

The rear face 48 of the washer adjacent to the opening includes inner bevel portion 60 that forms an angle between 40–50 degrees with longitudinal axis. Bevel 60 will make surface contact with the holder face frustoconical opening 22. That surface contact performs the advantage of aiding in the resistance to lateral displacement of the cutter bit 12 since it will abut the bevel 22 of the bore 21.

FIGS. 2 and 6–9 illustrate a second embodiment of the present invention wherein like and similar parts with the first embodiment are identified with the same numbers in the second embodiment. The holding washer Element in FIGS. 2 and 6 is shown in its holding position in which the spring clamp is held in its loaded position prior to being inserted into a bit holder block. As can be seen in FIGS. 2 and 6, the tip 8 of the cutting tool is conical as opposed to the flatter cap shaped tip 8 in FIG. 1. The shape of the tip of the cutter bit should not be limited to just those disclosed in these two embodiments but could alternatively be constructed from a variety of different shapes and geometries well-known in the industry.

The front face 44 of the washer in FIG. 7 has a plurality of evenly spaced gaps 57 and ridges 55 in the general shape of a U that extends from near the opening 52 of the washer to the outer periphery 50 of the washer. The rear surface of the washer has a U-shape recess 53 corresponding in shape and size to the U-shaped ridge on the top surface. In the inventions described above and illustrated herein, the entire top surface area of all the ridges contacts the bottom face of the cutter bit head. It is contemplated, however, that in some cutting bit assemblies, near the outside diameter of the holding washer the top face of the ridges 55 extend beyond the outside diameter of the bottom surface 9 of the cutter bit head. Therefore, only the radially inward portion of each top face of the ridges 55 provides support and forms a bearing surface for the rotating cutting tool.

The rear surface 48 of the second embodiment also sits flatly on the top face of the bit block as illustrated in FIG. 2. Hence, the contact between the washer and top face of the bit block is at a greater distance from the axis of rotation of the cutter bit than some prior art designs increasing torsion friction and resistance to relative rotation between the holding washer 19 and bit block face 23 as discussed above.

The recesses 53 in the holding element washer shown in FIGS. 2, 6–9 also prove to be useful in removing a cutter bit form the bit block. The recesses can be uniform depth, as best illustrated in FIG. 9, or have a tapered undercut to receive a bit removal tool as taught in U.S. Pat. No. 5,374,111, to Den Besten deceased et al., which is herein incorporated by reference in its entirety.

In a preferred embodiment, the undercuts taper upwardly from the underside surface of the flange toward the conical nose of the cutting bit. The undercuts taper upwardly at an angle of approximately 15 degrees from a line extending transversely from a longitudinal axis of the cutting bit.

The U-shaped ridges and recesses in the holding washer element disclosed in the second embodiment, FIGS. 2, 6–9, and the arcuate ridge segments and recesses in the first embodiment, FIGS. 1, 3–5, are exemplary only. The shape of the ridges and recesses on the holding washer elements should not be limited to just those disclosed in these two embodiments but could alternatively be constructed from a variety of different shapes and geometries.

The novel holding washer element 19 according to the present invention provides a very effective means for protecting the holding block 20 on which it is installed from abrasion and impact damage, thereby substantially increasing the useful life of the holding block. The holding washer 19 in the disclosed embodiments is generally ring shaped. It should be appreciated that said holding washer could instead have the general shape of a square, hexagon or other geometry. Further, it is not necessary that the holding washer 19 be employed to compress a clamping sleeve 17. The washer can be used with other rotating cutter bits for the purpose of enhancing rotation and reducing wear to the top face of the holder block.

The embossed washers of the invention have added strength in comparison to flat washers of the prior art. It is contemplated that as a result of this added strength, the general thickness of the washer from the front face to rear face (not at ridges or recesses) can be reduced, providing for savings in material cost and shaping ease in manufacturing the embossed washer. The embossed washer invention is made from typical Spring Steel employed and well known in the industry. The embossed washer may or may not be heat-treated. A Rockwell hardness value between 43–48 can provide for satisfactory results in some environments, whereas different Rockwell hardness values of the Spring Steel are more suitable for other environments.

Although the present invention has been described in connection with preferred embodiments thereof, it will be appreciated by those skilled in the art that additions, deletions, modifications, and substitutions not specifically described may be made without departing from the spirit and scope of the invention as disclosed.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiment described. I do intend that equivalents, adaptations and modifications reasonably inferable from the invention described herein be included within the scope of the invention as disclosed.

What is claimed is:

1. A washer for a rotatable cutting bit wherein the cutting bit has a cutter bit head that presents a bottom face, the washer comprising:

a front face, and a rear face, wherein said front face has a plurality of ridges wherein each one of the ridges has a top face that forms a bearing surface for contacting the bottom face of the cutter bit head.

2. The washer according to claim 1 wherein said ridges have an arcuate shape forming an arcuate segment.

3. The washer according to claim 1 wherein said front face has a plurality of gaps separating said plurality of ridges.

4. The washer according to claim 1 wherein said front face is generally flat.

5. The washer according to claim 1 wherein said rear face is generally flat.

6. The washer according to claim 1 wherein said rear face has a plurality of recesses.

7. The washer according to claim 6 wherein said plurality of recesses are uniformly spaced.

8. The washer according to claim 6 wherein said plurality of recesses are arcuate in shape forming arcuate segments.

9. The washer according to claim 6 wherein said rear face includes an inner bevel.

10. The washer according to claim 6 wherein said plurality of ridges are U-shaped.

11. The washer according to claim 6 wherein said plurality of recesses are generally U-shaped.

12. The washer according to claim 6 wherein said plurality of ridges are generally U-shaped.

13. A rotatable cutting bit assembly comprising:

a holder block, a cutting bit, and a washer, wherein said washer has at least one ridge to enhance rotation and reduce torsion friction.

14. The rotatable cutting bit assembly according to claim 13 wherein said at least one ridge is a plurality of ridges.

15. The rotatable cutting bit assembly according to claim 14 wherein said washer has a front face and a rear face, said plurality of ridges are on said front face.

16. The rotatable cutting bit assembly according to claim 15 wherein said rear face has a flat face.

17. The rotatable cutting bit assembly according to claim 15 wherein said rear face is generally flat and has a plurality of recesses.

18. The rotatable cutting bit assembly according to claim 17 wherein said holder block has a flat top surface, said flat rear surface cooperates with said flat top face to increase torsion friction.

19. The rotatable cutting bit assembly according to claim 14 wherein said ridges each have a top face forming a bearing surface for said cutting bit.

20. The rotatable cutting bit assembly according to claim 19 wherein said cutter bit has a cutter bit head with a bottom face for resting on said bearing surface.

21. A rotatable cutting bit assembly comprising:

a holder block having a generally flat top face, a cutting bit having a cutting bit head with a generally flat bottom face, and a washer including a front face and a generally flat rear face, said front face having a plurality of ridges, said ridges each have a top face forming a bearing surface for said cutting bit to enhance rotation of said cutter bit and said flat rear face reduces rotation of said washer.

22. The rotatable cutting bit assembly according to claim 21 wherein said rear face has a plurality of recesses.

23. The rotatable cutting bit assembly according to claim 21 wherein said plurality of ridges are arcuate segments.

24. The rotatable cutting bit assembly according to claim 23 wherein said front face has a plurality of uniformly spaced gaps separating said plurality of ridges.

25. The rotatable cutting bit assembly according to claim 21 wherein said plurality of ridges are uniformly spaced.

26. The rotatable cutting bit assembly according to claim 21 wherein said plurality of ridges are U-shaped and said front face has a plurality of uniformly spaced gaps separating said plurality of ridges.

27. The rotatable cutting bit assembly according to claim 21 further comprising:

a clamping sleeve.

28. The rotatable cutting bit assembly according to claim 21 wherein said rear face includes an inner bevel.

29. A washer for a rotatable cutting bit wherein the cutting bit has a cutter bit head that presents a bottom face, the washer comprising:

a generally flat front face, and a generally flat rear face, wherein said front face has a plurality of ridges with a plurality of gaps separating said plurality of ridges wherein each one of the ridges has a top face that forms a bearing surface for contacting the bottom face of the cutter bit head.

30. The washer according to claim 29 wherein said rear face has a plurality of recesses.

31. The washer according to claim 29 wherein said plurality of ridges are arcuate segments.

32. The washer according to claim 29 wherein said plurality of ridges are U-shaped.

33. The washer according to claim 29 wherein said washer has a central axis, said plurality of ridges are at an equal radial distance from said central axis.

34. The washer according to claim 29 wherein said plurality of ridges are arcuate segments, and said gaps form an arcuate opening and said arcuate opening forms an arc at least half the size of said arcuate segment.

35. A rotatable cutting bit assembly comprising:

a cutting bit having a cutting bit head with a generally flat bottom face, and a washer including a front face and a generally flat rear face, said front face having a plurality of ridges, said ridges each have a portion of a top face forming a bearing surface for said cutting bit to enhance rotation of said cutter bit and said flat rear face reduces rotation of said washer.

* * * * *